US010494240B2

(12) United States Patent
Matti

(10) Patent No.: US 10,494,240 B2
(45) Date of Patent: Dec. 3, 2019

(54) LOAD-BEARING SUPPORT

(71) Applicant: ROGAMA BV, Valkenburg (NL)

(72) Inventor: Rob Matti, Valkenburg (NL)

(73) Assignee: ROGAMA BV (NL)

( * ) Notice: Subject to any disclaimer, the term of this patent is extended or adjusted under 35 U.S.C. 154(b) by 402 days.

(21) Appl. No.: 15/310,561

(22) PCT Filed: May 19, 2015

(86) PCT No.: PCT/EP2015/060931
§ 371 (c)(1),
(2) Date: Jan. 11, 2017

(87) PCT Pub. No.: WO2015/177107
PCT Pub. Date: Nov. 26, 2015

(65) Prior Publication Data

US 2017/0113907 A1 Apr. 27, 2017

(30) Foreign Application Priority Data

May 19, 2014 (DE) ..... 10 2014 209 390

(51) Int. Cl.
*B66F 9/16* (2006.01)
*B66F 9/14* (2006.01)

(52) U.S. Cl.
CPC ..... *B66F 9/16* (2013.01); *B66F 9/148* (2013.01)

(58) Field of Classification Search
CPC ..... B66F 9/148; B66F 9/16
(Continued)

(56) References Cited

U.S. PATENT DOCUMENTS 3,734,327 A * 5/1973 Ellis, Jr. ..... B66F 9/148 414/641
4,960,357 A * 10/1990 Laursen ..... B66F 9/142 414/667

(Continued)

FOREIGN PATENT DOCUMENTS

DE 21 65 605 A1 7/1973
DE 10057239 A1 * 5/2002 ..... B66F 9/148

(Continued)

OTHER PUBLICATIONS

International Search Report for Application No. PCT/EP2015/060931 dated Jul. 29, 2015.

(Continued)

*Primary Examiner* — James Keenan
(74) *Attorney, Agent, or Firm* — Tarolli, Sundheim, Covell & Tummino LLP

(57) ABSTRACT

A load-bearing support is provided for an industrial truck, which can be fastened to another device. At least one load can be displaced horizontally in relation to the industrial truck and can be fastened in such a way that the load-bearing support can be tilted in vertical direction, wherein the area through which the driver of the industrial truck can see at a corresponding lifting height of a lifting carriage is maximized. The load-bearing support has a rear and a front part, wherein the front part of the load-bearing support has at least one upper holder and a lower holder for the at least one load and the two parts are connected to each other in such a way that the two parts can be rotated and laterally displaced.

15 Claims, 4 Drawing Sheets

Figure 1:
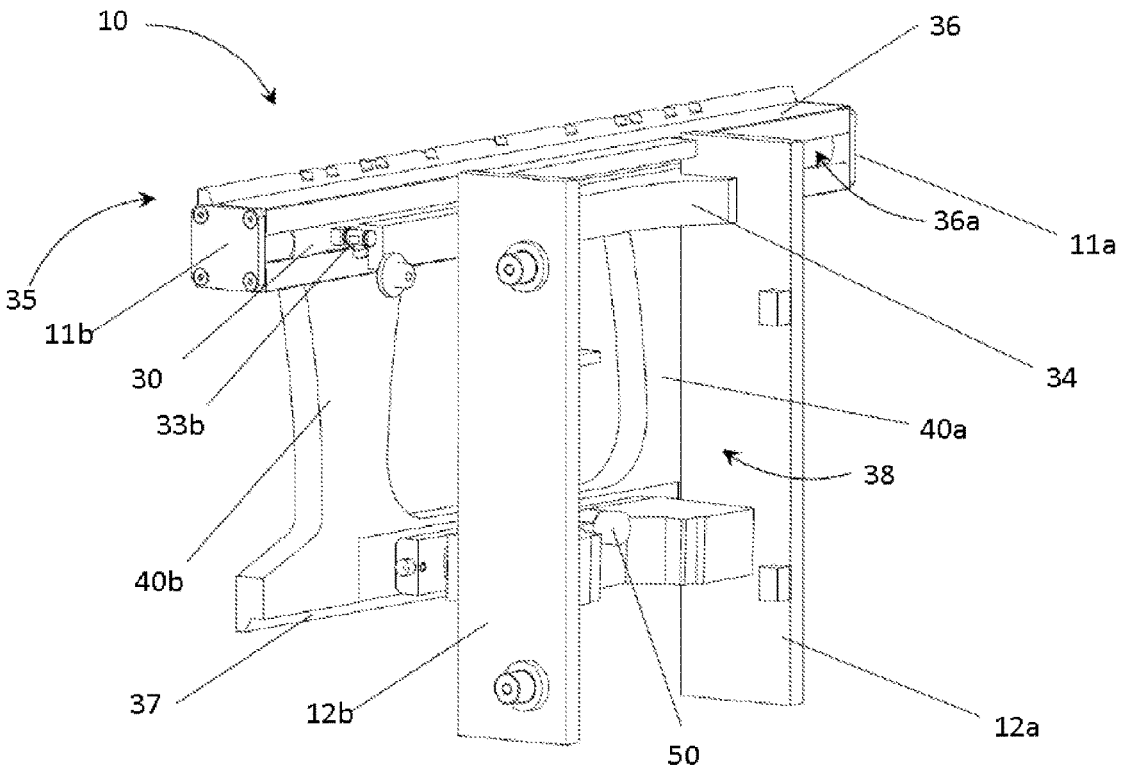

(58) Field of Classification Search
USPC ..... 414/667, 671
See application file for complete search history.

(56) References Cited

U.S. PATENT DOCUMENTS

| | | | | | |
|---|---|---|---|---|---|
| 5,033,934 | A * | 7/1991 | Emilio | B66F 9/142 | 414/667 |
| 5,807,060 | A * | 9/1998 | Hamlik | B66F 9/148 | 414/668 |
| 5,913,654 | A * | 6/1999 | Kaup | B66F 9/148 | 414/667 |
| 9,663,337 | B2 * | 5/2017 | Kuck | B66F 9/075 | |
| 10,087,060 | B2 * | 10/2018 | Hamlik | B66F 9/146 | |
| 2003/0156935 | A1 * | 8/2003 | Mondani | B66F 9/143 | 414/667 |
| 2008/0152471 | A1 | 6/2008 | Polvilampi | | |

FOREIGN PATENT DOCUMENTS

| | | | | | |
|---|---|---|---|---|---|
| DE | 10 2011 002433 | A1 | 7/2012 | | |
| EP | 2808289 | A1 * | 12/2014 | B66F 9/14 | |
| GB | 2266700 | A * | 11/1993 | B66F 9/148 | |

OTHER PUBLICATIONS

English Translation of Preliminary Report on Patentability for Application No. PCT/EP2015/060931.

* cited by examiner

LOAD-BEARING SUPPORT

RELATED APPLICATIONS

The present invention is a U.S. National Stage under 35 USC 371 patent application, claiming priority to Serial No. PCT/EP2015/060931, filed on 19 May 2015; which claims priority from DE 10 2014 209 390.2, filed 19 May 2014, the entirety of both of which are incorporated herein by reference.

The invention relates to a load-bearing support, which can be fastened to another device. This device can be a stationary or a movable device, wherein the movable device can be a vertically movable load carriage of an industrial truck, for example. The load-bearing support thereby has an upper and a lower bearing bar. The dimensions of the bearing bars as well as the distance thereof can correspond to the internationally standardized measurements. Load-bearing means can be appended to the bearing bars.

Such load-bearing supports can be integrated, for example, into an industrial truck or can be designed as attachment, which can be fastened or can be capable of being fastened to a device, such as a forklift, for example. For the most part, they have two or a plurality of load-bearing elements, which can be moved in parallel or horizontally relative to one another and which can have the shape of two forks, for example. This mobility of the forks is attained by means of a correspondingly designed adjusting device and makes it possible for the users to adapt the forks to the position of a load, which is to be supported. The entire industrial truck thus does not need to be backed against the load, which is to be held, in a highly accurate manner, but the fine-positioning of the load-supporting means can be made via the adjusting device. If a load, which is to be held, is positioned very closely against a fixed stop, for example against another load or a stationary wall, the load can even be supported by means of only such a horizontal adjusting possibility of the load-bearing elements. Vice versa, a load can also be set down eccentrically of the industrial truck, for example very close to another load or a stationary wall, by means of such a device. If the load-bearing elements can also be moved relative to one another in horizontal direction, the position of the load-bearing elements can be adapted to the width of an object to be held or to the recesses located thereon, respectively, with which the load-bearing elements, such as forks, for example, engage. A clamping of the load between the load-bearing elements is also a possible use of such adjusting devices. A device of the above-mentioned type, in the case of which the operator of the industrial truck controls the side thrust motion from his work station, without requiring him to step down, is known, for example, from published German patent application DE 10 2011 002 433 A1.

When bearing loads with a slight ground clearance, it is advantageous when the load-bearing means, for example the fork, can be tilted forwards into the forwards direction of motion of the industrial truck, so that the tips of the forks can be lowered. In contrast, the stability of the load during transport in the raised state can be increased in that the fork is tilted backwards in the direction opposite to the forwards direction of motion of the industrial truck, so that the tips of the forks are thus raised. By tilting the load-bearing means, the deflection of the forks can furthermore be compensated in response to corresponding loading. The tilt angle of the load-bearing means is typically between 5° to the top and 2° to the bottom in relation to the horizontal. To be able to vary the tilt of the load-bearing means of an industrial truck, systems are known, in the case of which the entire lifting frame of the industrial truck is tilted forwards or backwards, respectively. In the case of industrial trucks, in the case of which a tiltability of the lifting frame is not provided, it is known to fasten the fork support to the lifting carriage as separate component and to thereby provide a device for pivoting the fork support about a horizontal axis relative to the stationary lifting carriage. However, the industrial truck thereby has large frontal dimensions upstream of the lifting frame, which leads to an unfavorable weight distribution and thus to a limitation of the bearing load of the industrial truck. A large overall size is furthermore disadvantageous when using the industrial truck in narrow regions, for example of a warehouse.

A load-bearing support for an industrial truck is known from the published German patent application DE 10 2013 209 906 A1, to which at least one load-bearing means can be fastened and can be displaced horizontally in relation to the industrial truck and can be tilted in vertical direction. The load-bearing support has a rear and a front part, wherein the front part of the load-bearing support has at least one upper and a lower holder for the at least one load-bearing means, and the two parts are connected to one another in a rotatable manner. The rear part of the load-bearing support has at least two vertical mast jaws, which are connected via a connecting beam in the lower region of the load-bearing support. The vertical tilt of the at least one load-bearing means can be adjusted thereby by extending or retracting, respectively, at least two piston rods of at least two tilt cylinders, which are arranged in a substantially parallel manner. The housings of the at least two tilt cylinders are at least partially integrated into the connecting beam. The fork support and the axis of rotation and/or side thrust axis are located downstream from one another in the upper region of the load-bearing support, wherein the device has large frontal dimensions.

A load lifting carriage for an industrial forklift is known from published German patent application DE 4 315 293 A1, which has a mast arrangement and a load lifting carriage, which is attached in such a manner that it can be moved up and down on the mast. The carriage comprises a rear part, which is attached to the mast arrangement, a front part, which is articulated on the rear part and which can be pivoted about a horizontal axis, and supports a load support device, a first control device, which operates in longitudinal direction so as to move the front part together with the load-bearing device located thereon along the horizontal axis in relation to the rear part, and at least a second control device, which pivots the front part and the load-bearing device located thereon about the horizontal axis in relation to the rear part. To reduce the dimensions of the load lifting carriage, in particular in longitudinal vehicle direction, provision is made for the horizontal axis, about which the front part of the carriage is pivoted in relation to the rear part, coincides with the longitudinal axis of the first control device, which moves the front part laterally to the rear part during a sideways movement. The fork support is thereby appended to the piston rods for the sideways movement of the forks, wherein this region must be designed so as to be massive. The overall size is influenced unfavorably through this. In addition, the fork support is located below the cylinder or the cylinders, wherein the unobstructed view for the operator of the lift truck is limited.

Document U.S. 2008/0152471 A1 discloses a load-bearing support for an industrial truck, wherein at least one load-bearing means can be fastened to the load-bearing support and is designed in such a way that, by means of at least one cylinder, which is arranged in a cylinder housing and has a displaceably supported piston rod, the at least one load-bearing means can be displaced horizontally in relation to the industrial truck and can be tilted in vertical direction, and wherein the load-bearing support has a rear part and a front part, wherein the front part of the load-bearing support has an upper and a lower holder for the load-bearing means and the two parts are connected to one another in a rotatable and laterally displaceable manner. The rear part of the load-bearing support has two vertically arranged mast jaws, wherein the cylinder housing is connected horizontally to the two mast jaws in the upper region of the load-bearing support, and the upper holder of the load-bearing support encompasses maximally half of the cylinder housing in a rotatable and slideable manner. The load-bearing support is placed onto the cylinder housing from the top. A support block, which prevents the load-bearing support from deflecting upwards after a load is set down on a shelf, for example, in response to the retraction, is subsequently assembled in the lower region. This support block is to furthermore prevent the front part of the load-bearing support from being able to turn away towards the front, when the vehicle gets caught, for example on a bump on the ground, in response to moving backwards with the load-bearing means. The support block is thus a design element, which must be designed in a robust and removable manner. The load-bearing support thus becomes quite heavy, which has a negative impact on the maximally liftable load. The viewing window, which is available to the driver of the industrial truck, is furthermore reduced.

The upper holder of the front part of the load-bearing support, which bears on the wave-shaped cylinder housing, supports the at least one load-bearing means and substantially the entire load and must have a large stiffness and a high section modulus. In particular when two load-bearing means are fastened to the load-bearing support and when the two load-bearing means are in each case positioned completely on the outside on the upper holder and the upper holder protrudes outwards in the maximal lateral thrust and is not supported directly by the cylinder housing. This beam must thus be designed so as to be relatively high and heavy, which also has a negative impact on the maximally liftable load and on the visibility.

The upper and lower holder is connected to one another on the front part of the load-bearing support via two laterally arranged vertical connecting elements, which together form a rectangular structure. Because of the slight encompassing of the cylinder housing, these connecting elements must even be arranged laterally. One disadvantage is that these bars significantly limit the visibility of the driver past the lifting frame profile of the vehicle.

It is the object of the invention to specify a load-bearing support for an industrial truck, in the case of which at least one load-bearing means can be displaced horizontally in relation to the industrial truck and can be fastened so as to be capable of being tilted in vertical direction, wherein the area through which the driver of the industrial truck can see at corresponding lifting height of the lifting carriage, is maximized. The weight of the load-bearing support as well as the assembly effort is to furthermore be reduced as compared to the load-bearing supports known in the prior art.

According to the invention, this object is solved by means of a load-bearing support for an industrial truck as disclosed herein.

A load-bearing support according to the invention for an industrial truck is characterized in that at least one load-bearing means can be fastened to the load-bearing support and is designed in such a way that, by means of at least one cylinder, which is arranged in a cylinder housing and has a displaceably supported piston rod, the at least one load-bearing means can be displaced horizontally in relation to the industrial truck and can be tilted in vertical direction. The load-bearing support has a rear part and a front part, wherein the front part of the load-bearing support has at least one upper holder and a lower holder for the at least one load-bearing means and the two parts are connected to one another in a rotatable and laterally displaceable manner, wherein the rear part of the load-bearing support has at least two vertically arranged connecting elements or mast jaws, respectively. The connecting elements thereby represent the connection between the load-bearing support and the lifting frame profiles of the industrial truck, wherein the mast jaws can be connected directly, for example via a lifting chain, to the lifting frame profile of an industrial truck. In one embodiment option, these connecting elements can also be arranged upstream of the lifting frame profiles of the forklift. The cylinder housing, which is preferably designed as a shaft, is connected horizontally to the at least two mast jaws or connecting elements in the upper region of the load-bearing support, wherein the upper holder of the load-bearing support encompasses significantly more than half of the cylinder housing in a rotatable and shiftable manner. For example, the upper holder of the load-bearing support encompasses at least 65% of the cylinder housing in a rotatable and slideable manner. In another embodiment, the upper holder of the load-bearing support encompasses at least three quarters of the cylinder housing. The cylinder housing is thus integrated in the load-bearing support. The cylinder housing thus also takes over the task of a supporting shaft. Because of the application of force of the load-bearing support on the cylinder housing, the piston rods do not need to be designed larger than required for their actual task, namely the lateral displacement of the load-bearing support. The load of the load-bearing support is discharged via the cylinder housing, wherein the cylinder housing can support the static load, without having to be dimensioned especially large for this purpose. Because of the integrated structural shape, the load-bearing support is highly compact, wherein the front end at an industrial truck, which is equipped with the load-bearing support, is accordingly small, which has a positive impact on the maneuvering characteristics of the industrial truck. The area through which the driver of the industrial truck can see at corresponding lifting height of the lifting carriage is maximized, wherein the visual obstruction of the operator of the industrial truck is minimized. The fact that significantly more than half of the cylinder housing is encompassed by the upper holder of the load-bearing support reliably prevents the load-bearing support from deflecting upwards after a load is set down on a shelf, for example, in response to the retraction of the load-bearing support, without requiring further measures. In addition, the free cross section, through which the driver of the industrial truck can see, is not further limited. The weight of the load-bearing support is furthermore not increased by means of further components, which has an advantageous impact on the maximally liftable pay load and the energy efficiency when operating the industrial truck. In particular a support block as in the prior art is also not required. The upper holder can be designed as omega profile comprising an inner form analogously to the letter "C", that is, it can have a rounded inner contour and a substantially rectangular outer contour. The supporting material fibers are thereby located far apart, whereby a high section module against deformation is attained. The wall thicknesses of the profile can thus be designed so as to be smaller than would be the case when using a beam made of solid material, whereby the pay load, which can be lifted by the industrial truck, is increased further.

In an advantageous embodiment, the upper holder is formed in such a manner that the outer sides are substantially rectangular, while the inner side substantially has a round geometry. The upper straight outer side is the supporting area for the at least one hinged load-bearing means, the straight front side is the contact area for the substantially vertical back of the at least one load-bearing means, and the straight lower side forms the interface for the vertical connecting elements. The substantially round inner side encompasses the wave-shaped cylinder housing in a rotatable and displaceable manner.

This particular design of the upper holder of the load-bearing support results in a significantly higher section modulus than a simple beam. A large stiffness and a high section modulus are particularly important, when two load-bearing means, for example, are in each case positioned on the upper holder on the outside on the left and right and the force cannot be transferred directly to the cylinder housing. The upper holder supports the entire load, and in response to a transfer of the forces to the outer ends of the upper holder, the upper holder must not deform too much, in particular not deform plastically or bend. Because of the special design of the upper holder and because significantly more than half of the cylinder housing is encompassed by the upper holder, the entire height of construction of the upper holder is significantly smaller than a cylinder housing comprising an attached upper holder in the form of a beam.

In an advantageous embodiment, the upper holder has a longitudinal slit, which extends substantially across the entire width of the side of the upper holder, which points towards the rear part of the load-bearing support, in substantially horizontal direction. It furthermore turned out to be advantageous, when the cylinder housing is connected to the two mast jaws or connecting elements via an intermediate bar and when the intermediate bar is arranged downstream from the cylinder housing. The overall size is thus minimized further. The longitudinal slit extends substantially across the entire width of the upper holder downstream from the cylinder housing and thus does not have a negative impact on the visibility.

It is a further function of the intermediate bar that the free rotational movement or the vertical tilt, respectively, of the at least one load-bearing means is blocked upwards, when the specially formed profile of the upper holder of the load-bearing means strikes the intermediate bar on the top in response to the rotation. This blockade is chosen in such a way that the free rotational movement is as large as the tilt cylinder pushes the front part forwards, plus a certain safety distance. The forces, which occur, can be caught sufficiently towards the top and/or the front across the entire width of this contact area, if the tilt angle is too large.

It is also possible to minimize the opening or the clearance, respectively, to the top in the case of a maximum tilt of the at least one load-bearing means, via an adjusting means, such as adjusting screws or an adjustable bar, for example, which are assembled on the intermediate bar.

In a further advantageous embodiment, two single-acting piston rods are arranged in the cylinder housing. The lateral thrust motion of the load-bearing support is realized via these piston rods, wherein the single-acting piston rods are particularly compact. The number of the hydraulic connections is furthermore minimized, wherein the device is constructed in a simpler manner and can thus be maintained more easily. The overall size is also minimized further because of this structural shape.

In a particularly advantageous embodiment, the piston rods for the lateral displacement act directly against end elements on the outer sides of the load-bearing support, wherein the overall size of the load-bearing support is minimized further. In response to the assembly of the front part of the load-bearing support, the upper holder of the at least one load-bearing means is slid over the cylinder housing from the side and the end elements are assembled. At least one outer side of the upper holder must thus remain open via a removable end element.

In a particularly preferred embodiment, the piston rods are held completely in the load-bearing support. The piston rods are thus integrated in the load-bearing support so as to be protected and are protected especially against external influences. The overall size is furthermore optimized further with this.

It turned out to be advantageous, when all horizontal positions of the load-bearing support, which can be assumed, can be fixed by means of the cylinder housing with its piston rods. The cylinder housing comprising the piston rods thus bears the load-bearing support in position in all functional directions.

It furthermore turned out to be advantageous that the piston rods for the lateral movement of the load-bearing support are arranged on the axis of rotation of the vertical movement.

In an advantageous embodiment, the cylinder housing acts as sliding guide for the vertical rotational movement of the load-bearing support. In a particularly preferred embodiment, a replaceable wear bushing is introduced between the cylinder housing, which serves as shaft, and the inner side of the upper holder of the load-bearing support. In the event of wear, said wear bushing can be replaced easily and cost-efficiently. The wear bushing can be fastened to the cylinder housing as well as in the movable upper holder. It furthermore turned out to be advantageous, when the inner side of the upper holder is embodied so as to be substantially round.

In a further advantageous embodiment, connections for supplying the cylinder with hydraulic liquid are arranged on the side of the cylinder housing facing the rear part of the load-bearing support, for example in the longitudinal slit. They are thus positioned so as to be protected against external influences and do not have a negative impact on the overall size.

It furthermore turned out to be advantageous, when the upper holder and the lower holder of the load-bearing support are connected to one another via at least two vertical connecting elements, and the load-bearing support can be tilted vertically via at least one separate hydraulic cylinder, which acts against the lower holder. This design turned out to be robust and reliable in the case of a minimal overall size. On its lower side, the special form of the upper holder forms a connecting area for the vertical connecting elements. The large advantage of this design is that the position of the connecting elements can be chosen freely across the entire width. This means that these connecting elements can be arranged upstream of the lifting frame profiles, if possible, for optimal visibility. If, however, space is required in the frame, for example for further hydraulic components, the connecting elements can in each case be arranged on the outer side of the upper and lower holder.

Fork support, support beams adjusting cylinder for the lateral thrust motion, axis of rotation for the tilt of the load-bearing support and the blocking for lifting to the top and for limiting the rotational movement to the front, are thus integrated completely in each other, which leads to a stable design with minimal overall size.

The cylinder housing can be designed in a wave-shaped manner comprising two deep-drilled, single-acting cylinders. A significant part of the cylinder housing can thus remain as solid material, which has advantages in particular in the region, in which the forces are transferred via the intermediate bar to the connecting elements or mast jaws, respectively. In the alternative, the cylinder housing can also be designed completely of a cylinder pipe comprising a piston rod, which protrudes on one side, comprising a connection to the front part of the load support. The operating speeds and the forces, which are available for the movement to the two sides, are then different, because pressure is applied once to the bottom side without rod and once to the rod side of the piston.

Further advantages, special features and advantageous further developments of the invention follow from the subclaims and from the below illustration of preferred exemplary embodiments by means of the illustrations.

Figure 2:
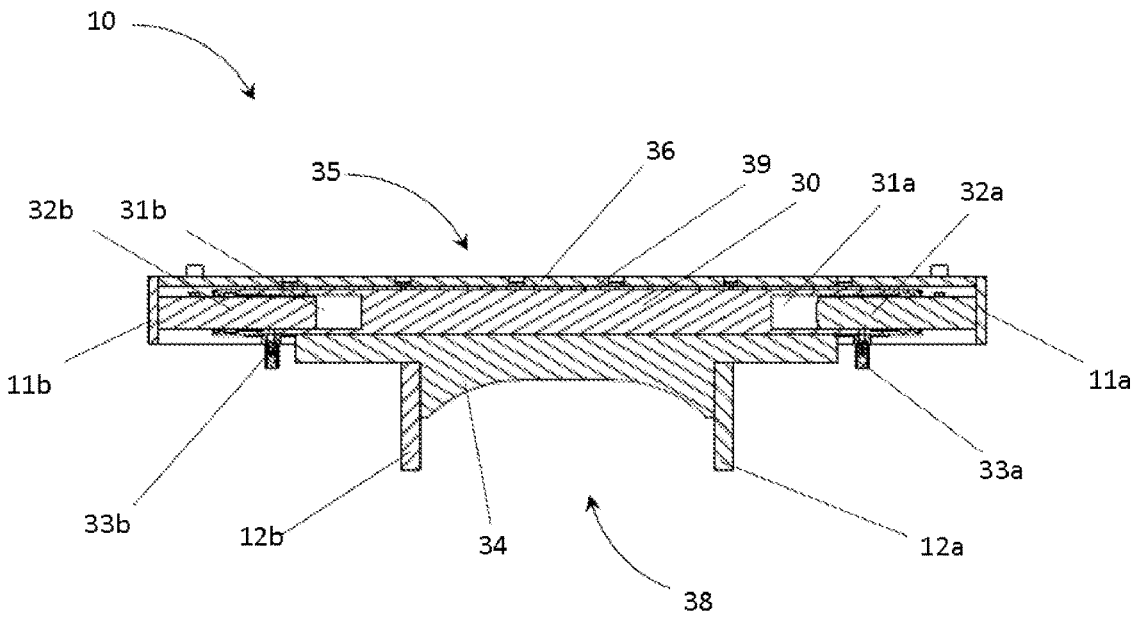
Figure 3:
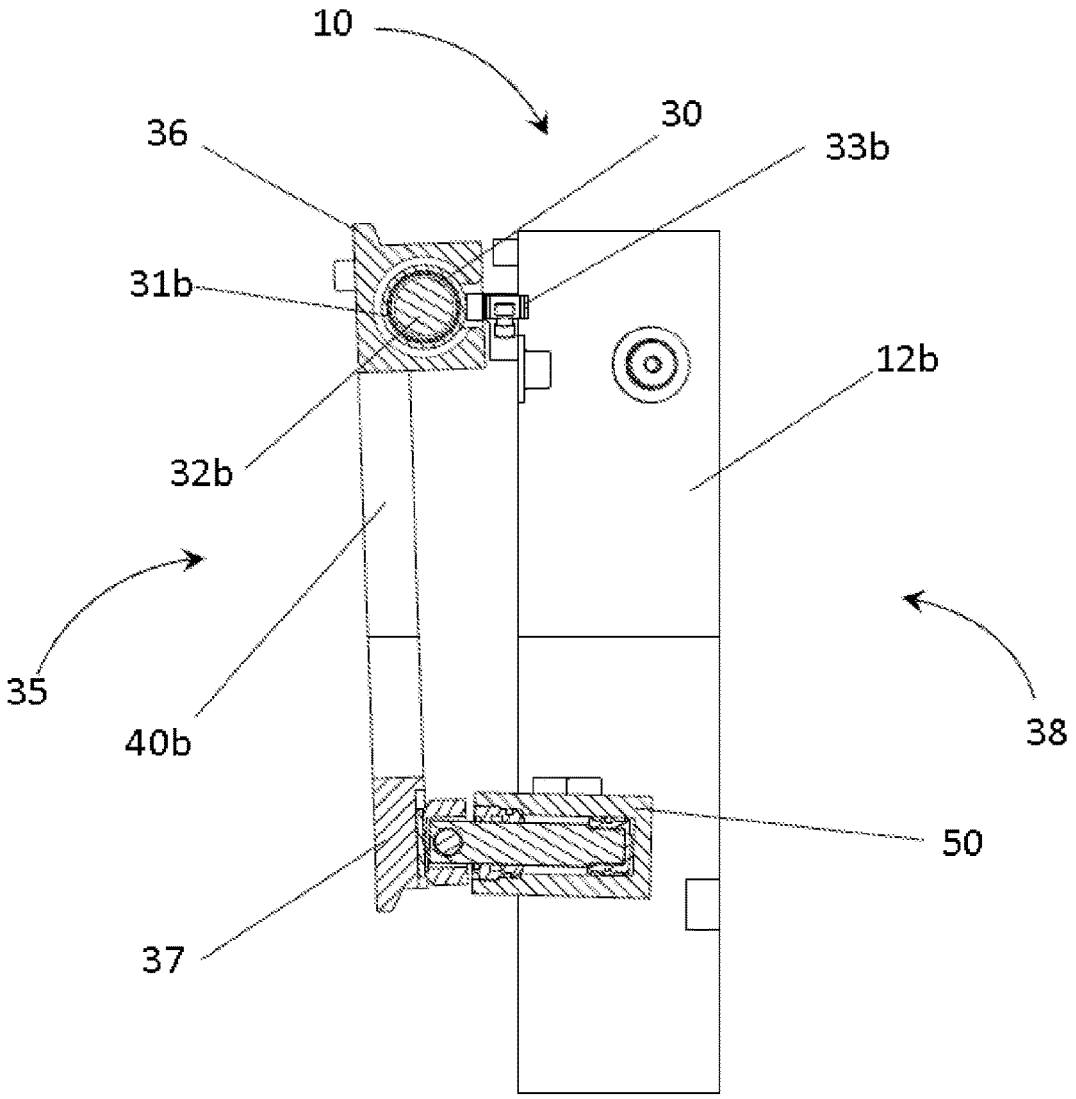
Figure 4:
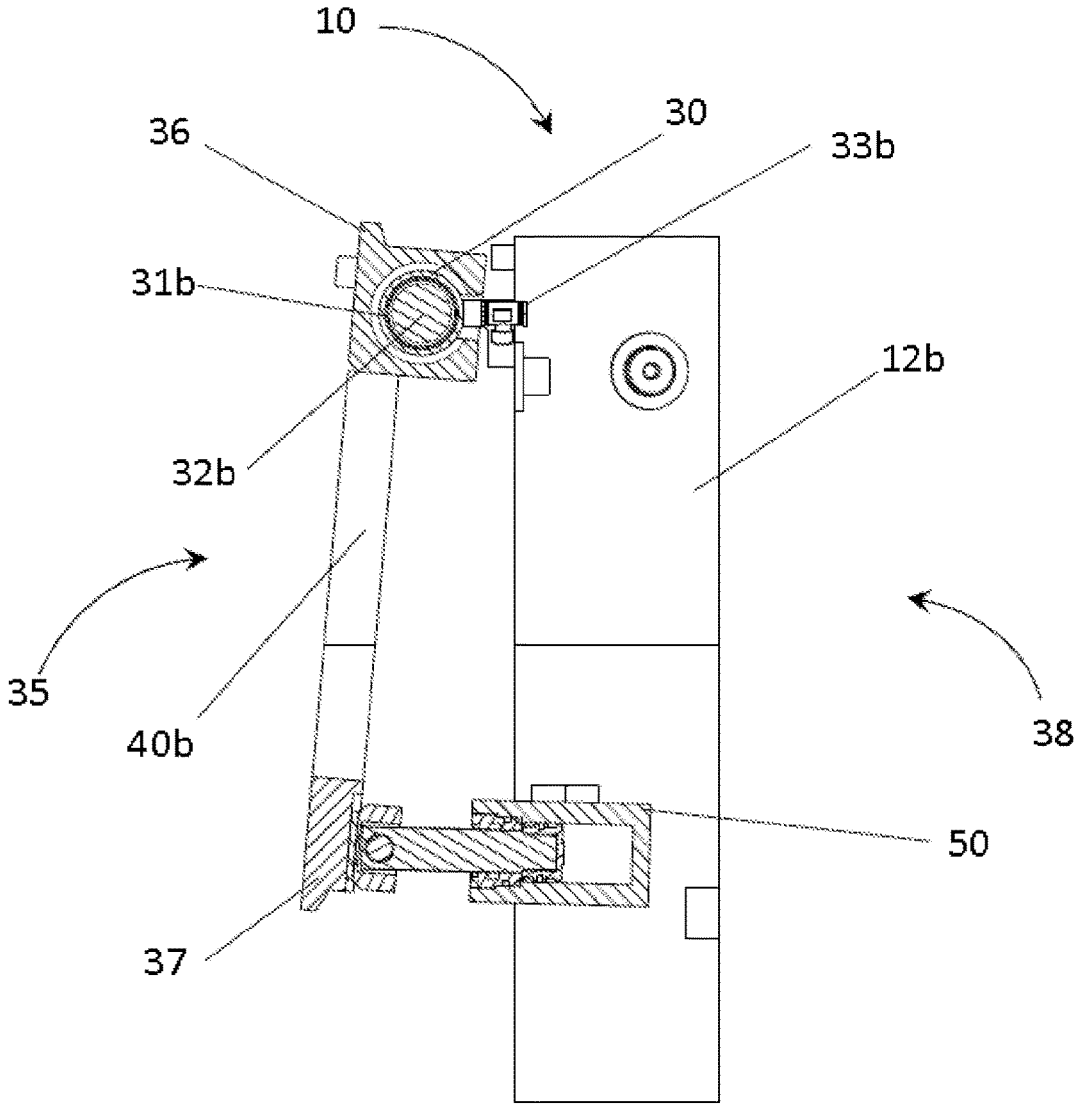

FIG. 1 shows a load-bearing support according to the invention in a three-dimensional view FIG. 2 shows a section through the cylinder housing FIG. 3 shows a load-bearing support according to the invention in a position, which is tilted backwards FIG. 4 shows a load-bearing support according to the invention in a position, which is tilted forwards.

FIG. 1 shows a load-bearing support 10 according to the invention in a three-dimensional view. The load-bearing support 10 can be fastened to an industrial truck, for example, and has a rear part 38 and a front part 35, wherein an upper holder 36 and a lower holder 37 for bearing a load-bearing means are provided on the front part 35. The load-bearing support 10 furthermore has two cylinders 31*a*, 31*b*, which are arranged in a cylinder housing 30 and in which a single-acting piston rod 32*a*, 32*b* is in each case supported in a horizontally displaceable manner. The piston rods 32*a*, 32*b* in each case act directly against end elements 11*a*, 11*b* on the outer sides of the load-bearing support 10. The load-bearing support is displaced laterally in relation to the industrial truck via a displacement of the piston rods 32*a*, 32*b*. On its front part 35, the load-bearing support 10 furthermore has an upper holder 36 and a lower holder 37, wherein load-bearing means, such as forklift forks, for example, can be fastened to these holders 36, 37. The holders 36, 37 are connected to one another via connecting elements 40*a*, 40*b*, wherein an opening, which grants unobstructed view through the load-bearing support to the operator of the industrial truck, is present between the connecting elements 40*a*, 40*b* in horizontal direction. The cylinder housing 30 is furthermore connected to two mast jaws (12*a*, 12*b*), which extend in vertical direction, via an intermediate bar 34. The load-bearing support can be tilted vertically via a separate hydraulic cylinder 50, which acts against the lower holder 37. The load-bearing support 10 thereby rotates about an axis of rotation, which corresponds to the longitudinal axis of the cylinder housing 30, wherein the load-bearing support 10 partially encompasses the cylinder housing 30 in a rotatable and slideable manner. All of the horizontal positions of the load-bearing support 10, which can be assumed, can be fixed through this. The piston rods 32*a*, 32*b* for the lateral movement of the load-bearing support 10 are arranged on the axis of rotation of the vertical movement, so that the longitudinal axis of the cylinder housing 30 simultaneously represents the axis of rotation for the tilt movement of the load-bearing support 10. The cylinder housing 30 thereby acts as sliding guide for the vertical rotational movement of the load-bearing support 10. The upper straight area of the intermediate bar 34 furthermore works as limitation of the vertical tilt, in that the upper holder 36 strikes against the intermediate bar on the top via the longitudinal slit.

A changeable wear bushing 39 is introduced between the cylinder housing 30 and the inner side of the upper holder 36 of the load-bearing support 10. In case of wear, this bushing 39 can be replaced easily and cost-efficiently.

The majority of the rear part 38 of the load-bearing support 10 is open via a longitudinal slit. Together with the opening between the connecting elements 40*a*, 40*b*, this provides the operator of the industrial truck with an unobstructed view in the forward direction and onto a held load.

FIG. 2 shows a section through the cylinder housing 30. The cylinder housing 30 houses the cylinders 31*a*, 31*b*, which, in turn, in each case have a piston rod 32*a*, 32*b*. These piston rods 32*a*, 32*b* in each case act directly against an end element 11*a*, 11*b* on each outer side of the load-bearing support 10. It can furthermore be seen in the sectional illustration that the load-bearing support 10 at least partially encompasses the cylinder housing 30 in a rotatable and slideable manner. The cylinders 31*a*, 31*b* have hydraulic connections 33*a*, 33*b*, which are arranged on the side of the cylinder housing (30), which faces the rear part 38 of the load-bearing support (10). The hydraulic connections are thus protected against external influences from the direction of the front part 35 of the load-bearing support 10.

FIG. 3 shows a load-bearing support 10 according to the invention in backwards-tilted position. A load-bearing means, which is fastened to the load-bearing support 10, is tilted downwards as a result of the backwards tilt of the load-bearing support 10. It is advantageous, for example, to hold a pallet with forks, which are tilted downwards, so as to counteract the risk that the forks catch on the pallet while moving the pallet downwards and displace the pallet. After the forks have been positioned below the pallet to the desired extent, the tilt can be adjusted, so that the pallet can be lifted horizontally. The tilt can also be adjusted to such an extent hereby that the forks are tilted at least slightly upwards, because the stability of the load on the forks is thus increased during the transport and the deflection of the forks is counteracted in the case of a heavy load. For adjusting the tilt, the piston rod of the hydraulic cylinder 50 is retracted. By linking the piston rod of the hydraulic cylinder 50 to the lower holder 37, the load-bearing support rotates about the longitudinal axis of the cylinder housing 30. The upper holder (36) of the load-bearing support (10) encompasses approximately 78% of the cylinder housing (30) in a rotatable and shiftable manner. A larger section modulus against a lifting of the load-bearing support (10), for example in response to retraction after setting down a load on a shelf, for example, is reliably prevented through this, without requiring further measures. In addition, the free cross section, through which the driver of the industrial truck can see, is not further limited. The weight of the load-bearing support (10) is furthermore not increased by means of further components, which has an advantageous impact on the maximally liftable pay load and the energy efficiency in response to the operation of the industrial truck.

FIG. 4 shows a load-bearing support according to the invention in forward-tilted position. A load-bearing means, which is fastened to the load-bearing support 10, is tilted upwards by tilting the load-bearing support 10 forwards.

The embodiments shown here only represent examples for the invention at hand and must thus not be understood as being limiting. Alternative embodiments considered by the person of skill in the art are similarly covered by the scope of protection of the invention at hand.

LIST OF REFERENCE NUMERALS

110 load-bearing support
11*a*, 11*b* end element
12*a*, 12*b* mast jaw, connecting element
30 cylinder housing
31*a*, 31*b* cylinder
32*a*, 32*b* piston rod
33*a*, 33*b* hydraulic connection
34 intermediate bar
35 front part
36 upper holder
36*a* longitudinal slit
37 lower holder
38 rear part
39 wear bushing
40*a*, 40*b* connecting element
50 hydraulic cylinder

The invention claimed is:

1. A load-bearing support for an industrial truck, wherein at least one load-bearing means is fastened to the load-bearing support and by means of at least one cylinder, which is arranged in a cylinder housing and has a displaceably supported piston rod, the at least one load-bearing means is displaceable horizontally in relation to the industrial truck and is tiltable in a vertical direction, and wherein the load-bearing support has a rear part and a front part, wherein the front part of the load-bearing support has at least one upper holder and a lower holder for the at least one load-bearing means and the two parts are connected to one another in a rotatable and laterally displaceable manner, wherein the rear part of the load-bearing support has at least two vertically arranged mast jaws, characterized in that the cylinder housing is connected horizontally to the at least two mast jaws in an upper region of the load-bearing support, and the upper holder of the load-bearing support encompasses significantly more than half of the cylinder housing, wherein the upper holder rotates with respect to the cylinder housing to tilt the load-bearing means in the vertical direction.

2. The load-bearing support according to claim 1, characterized in that the upper holder of the load-bearing support has a rectangular outer contour and a substantially round inner contour.

3. The load-bearing support according to claim 1, characterized in that the upper holder has a longitudinal slit, which extends substantially across the entire width of the side of the upper holder, which points towards the rear part of the load-bearing support, in substantially horizontal direction.

4. The load-bearing support according to claim 1, characterized in that the cylinder housing is connected to the two mast jaws via an intermediate bar, and the intermediate bar is arranged downstream, towards the rear part of the load-bearing support, from the cylinder housing.

5. The load-bearing support according to claim 4, characterized in that the upper holder is supported on the intermediate bar.

6. The load-bearing support according to claim 1, characterized in that two single-acting piston rods are arranged in the cylinder housing.

7. The load-bearing support according to claim 6, characterized in that the piston rods for the lateral displacement act directly against end elements on the outer sides of the load-bearing support.

8. The load-bearing support according to claim 6, characterized in that the piston rods are held completely in the load-bearing support.

9. The load-bearing support according to claim 1, characterized in that all possible horizontal positions of the load-bearing support are fixed by means of the cylinder housing with its piston rods.

10. The load-bearing support according to claim 1, characterized in that the piston rods for the lateral movement of the load-bearing support are arranged on the axis of rotation of a vertical movement.

11. The load-bearing support according to claim 1, characterized in that the cylinder housing acts as sliding guide for a vertical rotational movement of the load-bearing support.

12. The load-bearing support according to claim 11, characterized in that a changeable wear bushing is introduced between the cylinder housing and the inner side of the upper holder of the load-bearing support.

13. The load-bearing support according to claim 1, characterized in that hydraulic connections for supplying the cylinder with hydraulic liquid are arranged on the side of the cylinder housing facing the rear part of the load-bearing support.

14. The load-bearing support according to claim 1, characterized in that the upper holder and the lower holder of the load-bearing support are connected to one another via at least two vertical connecting elements, and the load-bearing support can be tilted vertically via at least one separate hydraulic cylinder, which acts against the lower holder.

15. The load-bearing support according to claim 14, characterized in that the lower side of the upper holder forms the connection for the vertical connecting elements.

* * * * *